US012637911B2

(12) United States Patent
Snoswell et al.

(10) Patent No.: US 12,637,911 B2
(45) Date of Patent: May 26, 2026

(54) DEVICES AND SYSTEMS FOR CUTTING ELEMENT ASSEMBLIES

(71) Applicant: Schlumberger Technology Corporation, Sugar Land, TX (US)

(72) Inventors: David Robert Evan Snoswell, Cambridge (GB); Ashley Bernard Johnson, Milton (GB); Mauro Caresta, Cambridge (GB); John Mervyn Cook, Cambridge (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/091,888

(22) Filed: Mar. 27, 2025

(65) Prior Publication Data

US 2025/0223874 A1 Jul. 10, 2025

Related U.S. Application Data

(62) Division of application No. 18/474,390, filed on Sep. 26, 2023, now Pat. No. 12,286,839.

(60) Provisional application No. 63/378,371, filed on Oct. 5, 2022.

(51) Int. Cl.
*E21B 10/62* (2006.01)

(52) U.S. Cl.
CPC ..... *E21B 10/62* (2013.01)

(58) Field of Classification Search
CPC ..... E21B 10/567; E21B 10/576; E21B 10/62; B23B 27/002; B23B 2200/16; B23B 2200/165; B23B 2200/163
See application file for complete search history.

(56) References Cited

U.S. PATENT DOCUMENTS 4,382,477 A * 5/1983 Barr ..... E21B 10/62 175/428
4,682,663 A * 7/1987 Daly ..... E21B 10/61 408/145
4,907,662 A * 3/1990 Deane ..... E21B 10/43 408/145
5,720,357 A * 2/1998 Fuller ..... E21B 10/567 175/428

(Continued)

FOREIGN PATENT DOCUMENTS

CN 204326973 U * 5/2015
CN 105156035 A * 12/2015

(Continued)

*Primary Examiner* — Jennifer H Gay
(74) *Attorney, Agent, or Firm* — Jeffrey D. Frantz

(57) ABSTRACT

A cutting element assembly includes a cutter support including a cutter bore. A cutting element is in the cutter bore and a resilient element is integral with the cutter support. The resilient element is longitudinally compressible and has a displacement of greater than 0.1 mm and optionally less than 2 mm. Another cutting assembly includes a cutter support coupled to multiple cutting elements. A resilient element of the cutter support is compressible based on a force applied to the cutter support through one or more of the cutting elements. The resilient element can include a slit in the cutter support. A slit may, for instance, extend perpendicular or transverse to an axis of the cutting elements and allow the cutter support to flex and close off or reduce a size of the slit when forces act on one or more of the cutting elements.

6 Claims, 10 Drawing Sheets

(56) References Cited

U.S. PATENT DOCUMENTS 6,142,250 A * 11/2000 Griffin ..... E21B 44/005 175/426
8,061,455 B2 * 11/2011 Beuershausen ..... E21B 7/064 175/426
8,079,431 B1 * 12/2011 Cooley ..... E21B 10/55 175/413
9,580,969 B2 * 2/2017 Wardley ..... E21B 17/14
9,759,015 B2 * 9/2017 Miess ..... E21B 10/567
10,000,977 B2 * 6/2018 Jain ..... E21B 10/62
10,066,444 B2 * 9/2018 Evans ..... E21B 10/602
10,267,096 B2 * 4/2019 Burhan ..... E21B 10/50
10,494,876 B2 * 12/2019 Mayer ..... E21B 10/62
10,697,247 B2 * 6/2020 Moss, Jr. ..... E21B 10/62
10,724,304 B2 * 7/2020 Bomidi ..... E21B 10/602
10,851,592 B2 * 12/2020 Schroder ..... E21B 10/25
11,142,959 B2 * 10/2021 Schroder ..... E21B 10/08
11,499,378 B2 * 11/2022 Zhang ..... E21B 10/62
12,286,839 B2 * 4/2025 Snoswell ..... E21B 10/573
12,337,428 B2 * 6/2025 Wang ..... E21B 10/573
2004/0173384 A1 * 9/2004 Yong ..... E21B 10/52 175/426
2010/0212964 A1 * 8/2010 Beuershausen ..... E21B 10/62 175/57
2013/0175097 A1 * 7/2013 Wardley ..... B23K 1/20 29/458
2014/0373458 A1 * 12/2014 Miess ..... E21B 10/567 51/309
2016/0053551 A1 * 2/2016 Jain ..... E21B 10/54 175/57
2017/0159369 A1 * 6/2017 Evans ..... E21B 7/00
2018/0258708 A1 * 9/2018 Burhan ..... E21B 10/633
2019/0032408 A1 * 1/2019 Schroder ..... E21B 10/62
2019/0032410 A1 * 1/2019 Moss, Jr. ..... E21B 10/325
2019/0040691 A1 * 2/2019 Mayer ..... E21B 12/00
2019/0063162 A1 * 2/2019 Bomidi ..... E21B 10/43
2019/0063163 A1 * 2/2019 Bomidi ..... E21B 10/485
2019/0078393 A1 * 3/2019 Moss, Jr. ..... E21B 10/55
2019/0145182 A1 * 5/2019 Bomidi ..... E21B 10/633 175/432
2020/0181986 A1 * 6/2020 Schroder ..... E21B 10/633
2022/0162914 A1 * 5/2022 Zhang ..... E21B 10/62
2024/0117682 A1 * 4/2024 Snoswell ..... E21B 10/62
2024/0300058 A1 * 9/2024 Wang ..... E21B 10/56
2025/0223874 A1 * 7/2025 Snoswell ..... E21B 10/573

FOREIGN PATENT DOCUMENTS

CN 105604491 A * 5/2016 ..... E21B 12/00
CN 118346182 A * 7/2024 ..... E21B 10/46
CN 119585502 A * 3/2025 ..... E21B 10/43
NO 850754 L * 8/1985 ..... E21B 10/573

* cited by examiner

DEVICES AND SYSTEMS FOR CUTTING ELEMENT ASSEMBLIES

CROSS-REFERENCE TO RELATED APPLICATIONS

This present application is a divisional of U.S. application Ser. No. 18/474,390, filed Sep. 26, 2023, now U.S. Pat. No. 12,286,839, entitled "Devices and Systems for cutting element assemblies", which claims priority from U.S. Provisional Appl. No. 63/378,371, filed on Oct. 5, 2022. Each of the foregoing is expressly incorporated herein by this reference.

BACKGROUND

Downhole drilling equipment may be used to reach subterranean reservoirs of oil, natural gas, water, and other natural resources. Downhole drilling equipment may drill wellbores that extend up to tens of thousands of feet in length. To advance a wellbore, a bit having a plurality of cutting elements is used. The bit is connected to a drill string and is rotated to degrade the formation and increase the depth of the wellbore.

SUMMARY

In some aspects, the techniques described herein relate to a cutting element assembly. The cutting element assembly includes a cutter support including a cutter bore. A cutting element is inserted into the cutter bore. A resilient element is integral with the cutter support. The resilient element is longitudinally compressible along a length of the cutter bore. The resilient element has a displacement of greater than 0.1 mm.

In some aspects, the techniques described herein relate to a cutting element assembly. The cutting element assembly includes a cutter support and a plurality of cutting elements connected to the cutter support. A resilient element is connected to the cutter support. The resilient element is compressible based on a force applied to the cutter support through one or more of the plurality of cutting elements.

In some aspects, the techniques described herein relate to a bit. The bit includes a bit body and a plurality of blades. A cutter support is connected to a blade of the plurality of blades. The cutter support includes a resilient element. A plurality of cutting elements are connected to the cutter support. The resilient element is located between the plurality of cutting elements and the blade of the plurality of blades.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which.

DETAILED DESCRIPTION

Figure 1:
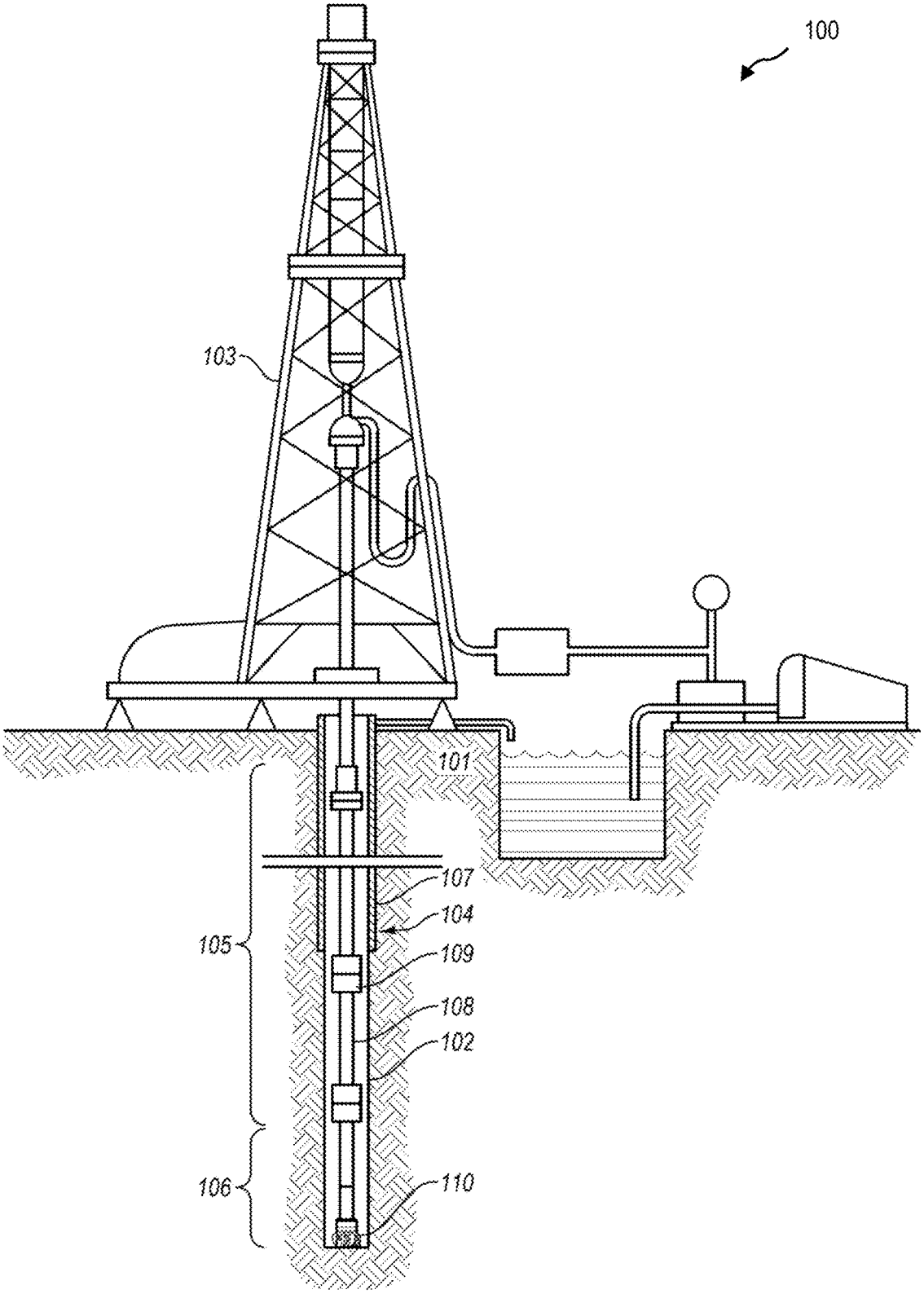
FIG. 1 is a representation of a drilling system, according to at least one embodiment of the present disclosure.

This disclosure generally relates to devices, systems, and methods for mounting a cutting element to a bit with a resilient element. During operation of a drilling system, a drill bit or other downhole tool may engage the formation with a cutting element. The cutting element is mounted to a cutter support and the cutter support is mounted to a blade or other support structure. In some situations, a rigid connection of the cutting element with the cutter support and/or the support structure may result in random contact length of the cutting element with the formation, contact force of the cutting element with the formation, chip size of chips in the formation, distance between chips in the formation, and so forth. A cutting element assembly may include a resilient element. The resilient element may help to maintain or increase contact of the cutting element with the formation during operation. This may help to increase the contact length, increase the contact force, increase the chip size, decrease the distance between chips, and so forth. This may improve drilling efficiency.

In accordance with at least one embodiment of the present disclosure, the resilient element is integrally formed with the cutter support. For example, the resilient element may be formed including one or more grooves, slots, or other voids in the cutter support. This may allow the cutter support to flex or otherwise move when the cutting element engages the formation. The level of resilience (e.g., the spring constant of the cutter support) may be determined based on the length, the depth, and the thickness of the groove. In some embodiments, the resilient element is additively manufactured (e.g., 3D printed) into the cutter support. Integrally forming the resilient element with the cutter support may allow the operator to precisely determine the level of resilience of the resilient element.

In accordance with at least one embodiment of the present disclosure, two or more cutting elements are connected to the same cutter support and supported by the same resilient element. This may allow the two or more cutting elements to be linked to the same resilient element. In this manner, the two cutting elements may be coupled, thereby applying a similar force to the formation at a similar time. During a rock fracture event near one cutter, the resilient element may experience a decrease in compression force. Subsequently elastic energy stored in the resilient element may be transferred to the second coupled cutter, temporarily increasing the compressive force on the rock. This sequence increases the probability that rock failure occurs in the vicinity of both coupled cutters simultaneously, synchronizing microfractures and removing a large volume of rock. This action may improve the consistency of the chips formed by the cutting element and/or reduce the spacing between two chips formed by adjacent cutting elements. Reduced spacing between chips may reduce the energy used to remove the material between the adjacent chips, thereby improving drilling efficiency.

FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of the drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110 or other components. An example BHA 106 may include additional or other components (e.g., coupled between to the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or damping tools, other components, or combinations of the foregoing. The BHA 106 may further include a rotary steerable system ("RSS"). The RSS may include directional drilling tools that change a direction of the bit 110, and thereby the trajectory of the wellbore. At least a portion of the RSS may maintain a geostationary position relative to an absolute reference frame, such as gravity, magnetic north, and/or true north. Using measurements obtained with the geostationary position, the RSS may locate the bit 110, change the course of the bit 110, and direct the directional drilling tools on a projected trajectory.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be or include a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface, or may be allowed to fall downhole.

The bit 110 may include one or more cutting elements. The cutting elements may be connected to a blade or other support structure. When the cutting elements engage the formation, the cutting elements may cause the formation to chip, spall, or otherwise degrade the formation. The drilling rate may be the rate at which the bit 110 degrades the formation to increase the depth of the wellbore 102. The drilling rate may be based on the force applied to the bit 110 (e.g., the weight-on-bit (WOB)), the rotational rate of the bit 110 (e.g., the rotation per minute (RPM)), the drilling fluid flow rate, any other factor, and combinations thereof.

The wellbore surface may be uneven, based on the fracturing of the formation and/or geological variations in the formation. As the cutting elements engage the formation, the cutting elements may chip out portions of the formation. In some situations, chipping the formation may cause the cutting elements to jump or skitter across the formation. Jumping or skittering of the cutting elements may result in uneven contact, including an uneven contact length and/or uneven contact force, of the cutting elements with the formation.

In accordance with at least one embodiment of the present disclosure, the cutting elements may be connected to the support structure with a resilient element. The resilient element may help to dampen or smooth out the contact of the cutting elements with the formation. In some embodiments, this may increase the contact length of the cutting elements with the formation, thereby allowing the cutting elements to remove more formation material. In some embodiments, the resilient element may help to apply a consistent force to the formation, thereby causing the chips formed by the cutting element to have similar sizes and/or volume, thereby allowing further passes of the bit to remove more material.

In some embodiments, two or more cutting elements may be coupled together with a single resilient element. This may couple the cutting action of the coupled cutting elements, thereby reducing the spacing between chips from adjacent cutting elements and improving the rate of penetration of the bit 110.

Figure 2:
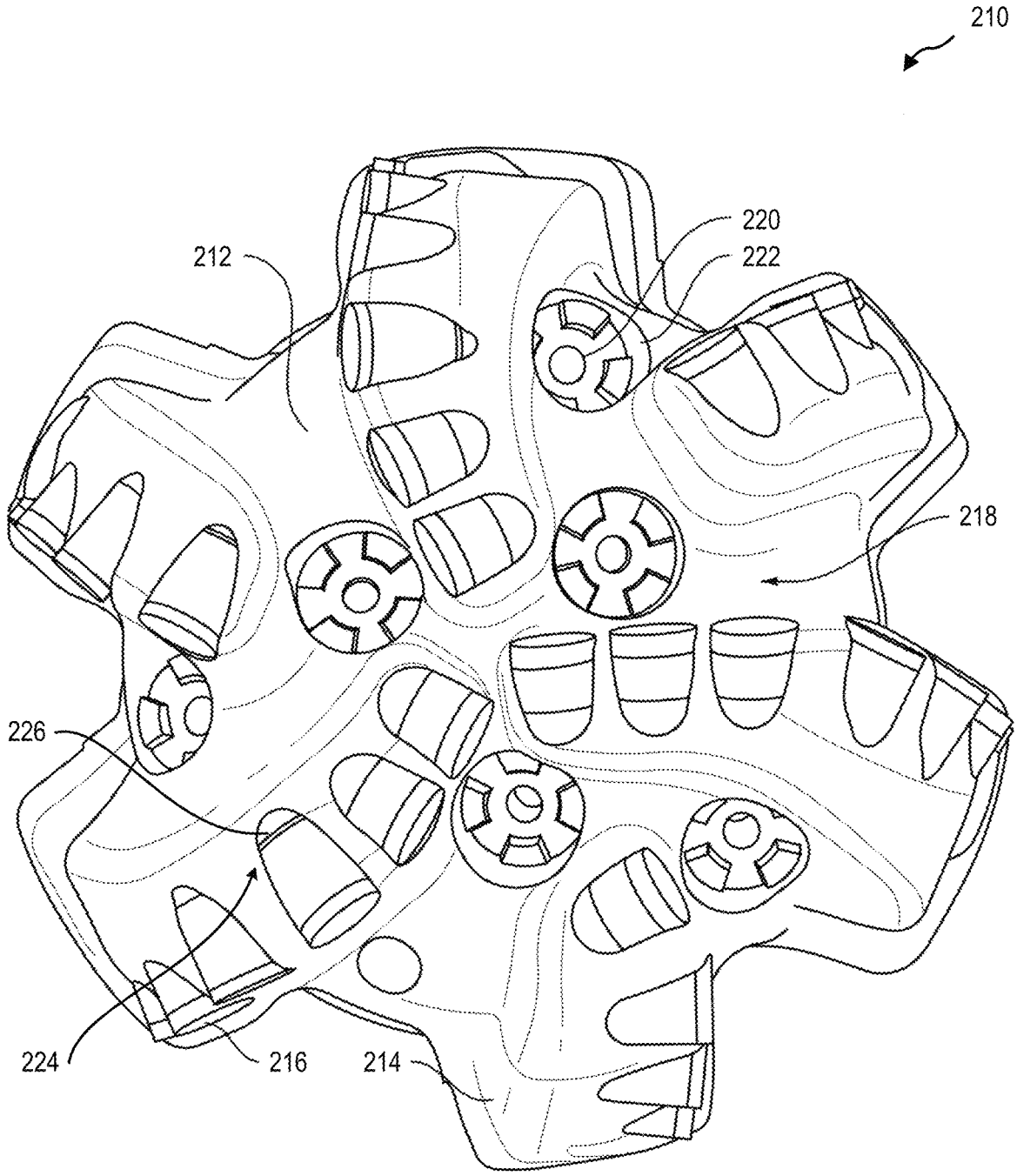
FIG. 2 is a representation of the downhole end of an embodiment of a bit, according to at least one embodiment of the present disclosure.

FIG. 2 is a representation of the downhole end of an embodiment of a bit 210. The bit 210 may include a bit body 212 from which a plurality of blades 214 may protrude. At least one of the blades 214 may have a plurality of cutting elements 216 connected thereto. In some embodiments, at least one of the cutting elements may be a planar cutting element, such as a shear cutting element. In other embodiments, at least one of the cutting elements may be a non-planar cutting element, such as a conical cutting element or a ridged cutting element. A junk slot 218 may be located between two blades 214. A nozzle 220 may be inserted into a nozzle port 222. The nozzle 220 may direct drilling fluid to clear cuttings generated by the cutting elements 216 from the working face. The cuttings carried by the drilling fluid may pass through the junk slot 218 and into an annulus between the drill string and the wellbore wall.

The cutting elements 216 may be secured in the blades 214 with a cutter support 224. The cutter support 224 may be connected to a blade 214. As discussed herein, the cutter support 224 may include a resilient element 226. During drilling operations, the resilient element 226 may dampen or absorb at least a portion of the force applied to the connected cutting element 216 based on engagement of the cutting element 216 with the formation. For example, the resilient element 226 may dampen or absorb spikes in the force applied to the connected cutting element 216. This may help to increase the length of time the cutting element 216 is engaged with the formation.

In some embodiments, multiple cutting elements 216 on the same blade 214 may be connected to the same cutter support 224 and/or the same resilient element 226. This may help to couple the forces of multiple cutting elements 216 during operation. In this manner, the chips created by the cutting elements 216 may be more even and have a smaller spacing between the chips, thereby improving the drilling efficiency of the bit 210.

Figure 3:
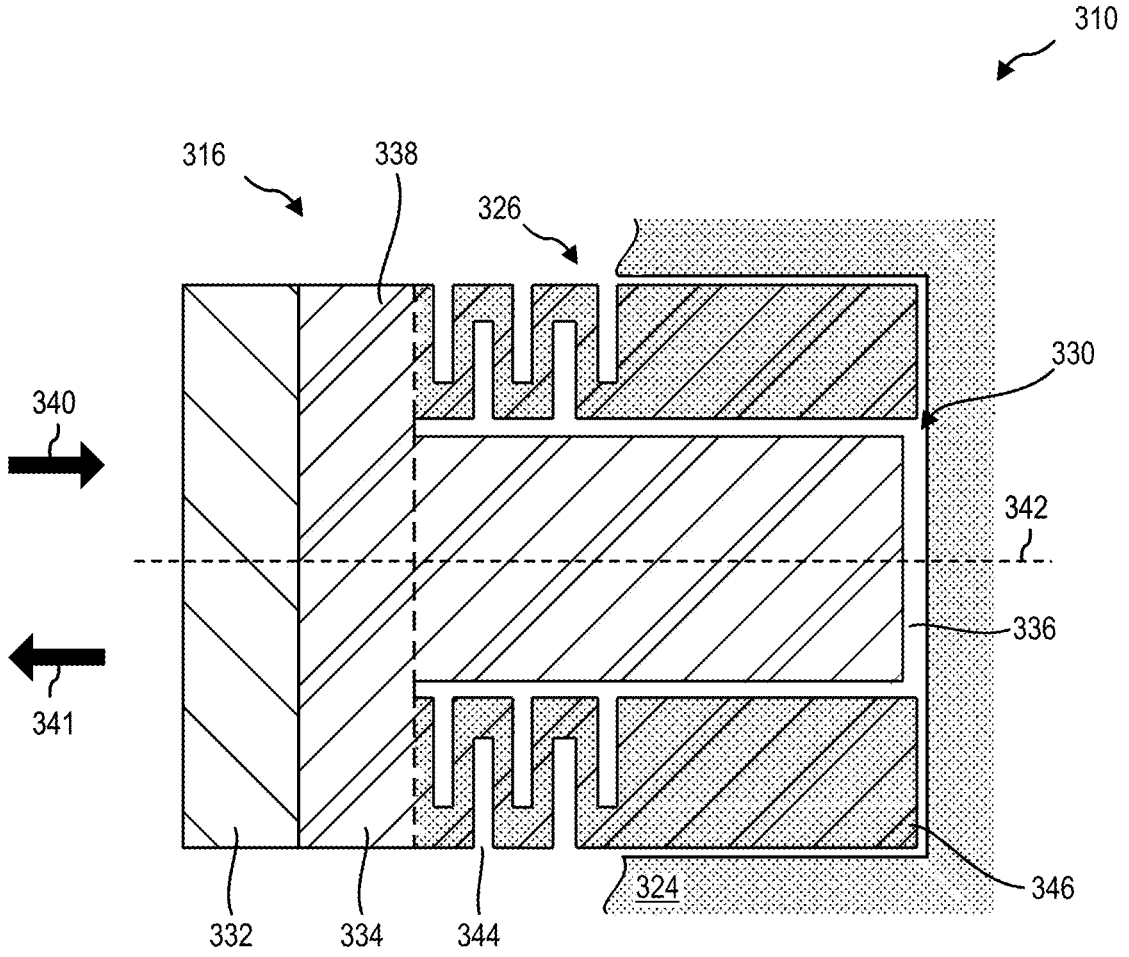
FIG. 3 is a schematic view of a cutting element assembly, according to at least one embodiment of the present disclosure.

FIG. 3 is a schematic view of a cutting element assembly 310, according to at least one embodiment of the present disclosure. The cutting element assembly 310 includes a cutter support 324. The cutter support 324 may be connected to a support structure. For example, the cutter support 324 may be connected to a blade of a bit. In some embodiments, the cutter support 324 is connected to any other support structure in a downhole tool. For example, the cutter support 324 may be connected to the blade of a reamer. In some examples, the cutter support 324 is connected to the blade of an expandable cutting tool, such as an expandable reamer, a casing cutter, a mill, any other fixed or expandable cutting tool, and combinations thereof. In some embodiments, the cutter support 324 may be connected to any support structure of any cutting tool.

A cutting element 316 may be coupled to the cutter support 324. For example, the cutter support 324 may form a cutter bore 330. The cutter bore 330 may be a hollow, a bore, or other space in the cutter support 324. The cutting element 316 may be at least partially inserted into the cutter bore 330. The cutting element 316 may be retained in the cutter bore 330. In some embodiments, the cutting element 316 may be a rotating cutting element and retained in the bore with a rotating connection, such as a snap ring or other rotating connection. In some embodiments, the cutting element 316 may be brazed or otherwise connected to the cutter support 324.

The cutting element 316 may include a cutting table 332 connected to a substrate 334. The cutting table 332 may be formed from a cutting material, including an ultrahard material such as polycrystalline diamond (PDC), natural diamond, cubic boron nitride (CBN), or another ultrahard material. The substrate 334 may be formed from a matrix material, such as a tungsten carbide (WC) matrix or other matrix material. The substrate 334 may be inserted into the cutter bore 330 to secure the cutting element 316 to the cutter support 324. In the embodiment shown, the substrate 334 includes a tapered portion 336 and a shoulder 338. The tapered portion 336 may be inserted into the cutter bore 330. Optionally, the shoulder 338 rests on or contacts the cutter support 324, although as shown in FIG. 3, the shoulder 338 may also be spaced from the cutter support 324.

As discussed herein, the cutting element assembly 310 may include a resilient element 326. The resilient element 326 may be compressible along a length of the cutting element and/or the cutter bore 330. During operation, the cutting element 316 may experience forces, including in a generally inward direction 340. For example, the cutting element 316 may experience forces that have a component parallel or generally parallel to a longitudinal axis 342 of the cutting element 316 and may be oriented or directed toward the cutter support 324. In some embodiments, the cutting element 316 may experience forces that are transverse to the longitudinal axis 342 and the forces may be transferred to the generally inward direction 340. For example, the tapered portion 336 may be confined in the cutter bore 330 by the walls of the cutter support 324, and a force transverse to the longitudinal axis 342 may cause the tapered portion 336 to engage the walls of the cutter support 324 and cause movement or transfer of the force to the generally inward direction 340.

When the cutting element 316 experiences forces in the generally inward direction 340, the cutting element 316 may transfer the forces to the resilient element 326. This may cause the resilient element 326 to compress in the generally inward direction 340, or along a length of the cutter bore or along a length of the cutting element 316. Compressing the cutting element 316 in the generally inward direction 340 may help to absorb forces experienced by the cutting element 316.

In accordance with at least one embodiment of the present disclosure, the resilient element 326 may be integrally formed with the cutter support 324. When the cutting element 316 experiences forces in the generally inward direction 340, the cutting element 316 may experience movement in the generally inward direction 340. The resilient element 326 may experience compression based on the force and/or movement in the generally inward direction 340. In some embodiments, the resilient element 326 may be more resilient than a solid block of the resilient element 326 (e.g., tapered portion 336).

During operation, when the cutting element 316 experiences a force in the generally inward direction 340, the resilient element 326 may deform in response to at least a portion of the force in the generally inward direction 340. When the force on the cutting element 316 decreases, at least a portion of the force may be applied in a generally outward direction 341 as the resilient element 326 deforms and potentially returns to a prior shape or structure. This force may be transferred to the cutting element 316. In some embodiments, this outward force may cause the cutting element 316 to move in the generally outward direction 341. In some embodiments, this outward force may cause the cutting element 316 to apply the outward force from the resilient element 326 to the formation.

When the cutting element experiences a force, that force will be transmitted through the resilient element 326. This may cause the resilient element 326 to compress and the cutting element 316 to move inward. As the bit rotates and the cutter mount moves at a constant speed or at a variable speed, the inward displacement of the cutting element 316 can be reduced as can the contact force on the target media (e.g., the formation). The effect of the resilient element 326 may be to reduce the impact force of the cutting element 316, and the resilient element 326 may appear to absorb the force. In this manner, as used herein, "absorbing" the force may include deforming the resilient member 326 in response to the force and/or reducing the impact force on the cutting element 316 due to the inward displacement of the cutting element 316.

In some embodiments, the resilient element 326 may help to smooth or even out the forces applied to the cutting element 316. An even force applied to the cutting element 316 may depress or cause the resilient element 326 to absorb an even amount of force, or apply an even amount of resistance to movement of the cutting element 316 in the generally inward direction 340.

An uneven force applied to the cutting element 316 may be at least partially damped or smoothed by the resilient element 326. For example, during a spike in the force applied to the cutting element 316, or an increase in force from a baseline or average force, the resilient element 326 may absorb at least a portion of the excess force. When the force applied to the cutting element 316 is decreased, the resilient element 326 may apply the absorbed force in the generally outward direction 341, which may then be transferred to the cutting element 316 and through the cutting element 316 to the formation. In this manner, the force applied by the cutting table 332 to the formation may be smoothed over, or may have reduced peaks and valleys from an average force. This may help to improve drilling efficiency, which may result in an increased rate of penetration.

In some embodiments, the resilient element 326 helps to maintain contact of the cutting element 316 with the formation. For example, the force may cause the cutting element 316 to move in the cutter bore 330 in the generally inward direction 340. The cutting element 316 may move with a displacement. In some embodiments, the displacement may be in a range having an upper value, a lower value, or upper and lower values including any of 0.01 mm, 0.05 mm, 0.10 mm, 0.15 mm, 0.20 mm, 0.25 mm, 0.30 mm, 0.35 mm, 0.40 mm, 0.45 mm, 0.50 mm, 0.1 mm, 0.25 mm, 0.5 mm, 1 mm, or any value therebetween. For example, the displacement may be greater than 0.01 mm. In the same or other examples, the displacement may be less than 1 mm, less than 0.5 mm, less than 0.25 mm, less than 0.1 mm, or less than 0.50 mm. In yet other examples, the displacement may be any value in a range between 0.01 mm and 1 mm (e.g., between 0.01 mm and 0.50 mm). In some embodiments, it may be critical that the displacement is greater than 0.10 mm to increase the contact of the cutting element 316 with the formation.

When the cutting element 316 moves in the generally inward direction 340 based on a spike or change in the force applied to the cutting element 316, the resilient element 326 may move at least a portion of the cutting element 316 in the generally outward direction 341 when the spike or change in force is reduced. Such a change or spike in force may cause the cutting element 316 to jump or skitter across the formation, thereby reducing contact of the cutting element 316 with the formation. In accordance with at least one embodiment of the present disclosure, when the cutting element 316 moves in the generally inward direction 340 during a spike or other change in force which may cause the cutting element 316 to jump, when the spike/change is reduced, the cutting element 316 may maintain contact with the formation because the resilient element 326 may move at least a portion of the cutting element 316 back toward the formation.

The resilient element 326 may be integrally formed with the cutter support 324 and/or the tapered portion 336, or may be formed separately. Further, the length of the resilient element 326 may be the same as the tapered portion 336, or may be different. In some examples, the resilient element 326 includes one or more grooves 344. These grooves 344 may provide room for the material of the cutter support 324 to deflect upon application of a generally inward direction 340. In some embodiments, the material properties of the cutter support 324 may include an elasticity (often quantified by the Young's Modulus). The elasticity may be a representation of the amount of force and deflection the resilient element 326 of the cutter support 324 may absorb before undergoing plastic deformation and/or fracture. Put another way, the elasticity may be a representation of how much force the resilient element 326 may absorb and release without damage to the cutting elements 316. In some embodiments, the resilient element 326 may be more resilient than a solid block of the material that forms one or more of the resilient element 326, the tapered portion 336, or the substrate 334. For example, the grooves 344 may allow the resilient element 326 to be more resilient than a solid block of the material that forms one or more of the resilient element 326, the tapered portion 336, or the substrate 334.

In some embodiments, the grooves 344 may be circumferential or helical grooves. For example, the grooves 344 may extend around a circumference or a perimeter of the cutter support 324. This may allow the resilient element 326 to absorb force equally around the circumference or perimeter of the cutter support 324. In some embodiments, the grooves 344 may be located at an outer surface of the cutter support 324. In some embodiments, the grooves 344 may be located on an inner surface of the cutter support 324. In some embodiments, the grooves 344 may extend partially through the body of the cutter support 324. In some embodiments, a groove 344 may extend through an entirety of the body of the cutter support 324.

In the embodiment shown, the grooves 344 are oriented perpendicular to the longitudinal axis 342 (e.g., the grooves 344 extend perpendicular to the longitudinal axis 342 of the cutting element 316). In this manner, the deflection of the material of the resilient element 326 may be oriented parallel to forces in the generally inward direction 340. This may increase the efficiency and/or effectiveness of the resilient element 326. In some embodiments, the grooves 344 may have another orientation with respect to the longitudinal axis 342. For example, the grooves 344 may be oriented transverse (e.g., not parallel) to the longitudinal axis 342. In some embodiments, the grooves 344 may be oriented with respect to the direction of the forces experienced by the cutting element 316.

In some embodiments, the resilient element 326 may include multiple grooves 344 in the cutter support 324. Multiple grooves may increase the elasticity of the resilient element 326 without placing a damaging amount of stress on the material of the cutter support 324. In some embodiments, adjacent grooves 344 may be located on opposite sides of the cutter support 324. For example, a first groove 344 may be located on an outer surface of the cutter support 324 and a second groove located immediately adjacent to the first groove 344 may be located on the inner surface of the cutter support 324. Locating adjacent grooves 344 on opposite sides of the cutter support 324 may allow the resilient element 326 to deform or compress in the generally inward direction 340 evenly.

In some embodiments, the resilient element 326 may include a single groove 344. The single groove 344 may be oriented in a helix or spiral around the cutter support 324 (e.g., extends in a spiral along a full or partial length of the cutter support 324). In some embodiments, the single spiraled groove 344 may extend through an entirety of the body of the cutter support 324 (e.g., extends in a spiral along the entire length of the cutter support 324).

In some embodiments, the resilient element 326 may have the same structure around an entirety of a circumference of the cutter support 324. In some embodiments, the resilient element 326 may have a different structure in different portions of the perimeter or circumference of the cutter support 324. For example, the resilient element 326 may be stiffer in some portions of the cutter support 324 and more resilient in other portions of the cutter support 324. This may help to balance the movement or displacement of the cutting element 316 based on forces that are not parallel to the longitudinal axis 342, thereby helping to reduce binding or uneven wear of the cutting element 316 and/or the cutter support 324.

In some embodiments, the grooves 344 may be formed after the cutter support 324 is formed. For example, the grooves 344 may be machined into the cutter support 324 after the cutter support 324 is formed. In some embodiments, the grooves 344 may be formed during formation of the cutter support 324. For example, the grooves 344 may be cast or molded with the cutter support 324 during formation of the cutter support 324. In some embodiments, the cutter support 324 may be formed using an additive manufacturing process (e.g., 3D printing). 3D printing the cutter support 324 may allow the grooves 344 to be formed in any shape. For example, 3D printing the cutter support 324 may allow for complex geometries of the grooves 344 to be formed, including internal structures, grooves, spirals, and other geometries.

In some embodiments, the resilient element 326 is formed from the same material as the cutting element 316. For instance, the substrate 334 may be formed from a single monolithic piece of material, and the grooves 344 may be formed from the monolithic piece of the material. In some embodiments, the resilient element 326 may be formed from a different material than the substrate. For instance, the base 346 may be part of the cutter support 324 (see, e.g., FIG. 4), and the tapered portion 336 may be inserted in a bore therein. The resilient element 326 may be formed from a material that is more elastic than the base 346. The base 346 may provide structural strength to support operational forces and the resilient element 326 may help to smooth or flatten forces incurred during operation, as discussed herein.

In some embodiments, the resilient element 326 may act as a spring. The resilient element 326 may have a spring constant. In some embodiments, the resilient element 326 may have the same spring constant along a length of the resilient element 326. In some embodiments, the resilient element 326 has a variable spring constant, or a spring constant that varies along a length of the resilient element 326. This may help to provide a displacement and/or force resistance that is based on an anticipated force profile. For example, if a force profile of the cutting element assembly includes a known variation of force with few spikes, a first spring constant may be configured to absorb force from the standard variation in the force profile. A second spring constant may be stiffer than the first spring constant to absorb force from spikes beyond the standard variation in the force profile. In this manner, the resilient element 326 may be tailored for a particular application.

In the embodiment shown, the resilient element 326 is located on, or coupled to, the substrate 334 near the shoulder 338 of the tapered portion 336. However, it should be understood that the resilient element 326 may be located at any location along a length of the substrate 334 or cutter support 324.

Figure 4:
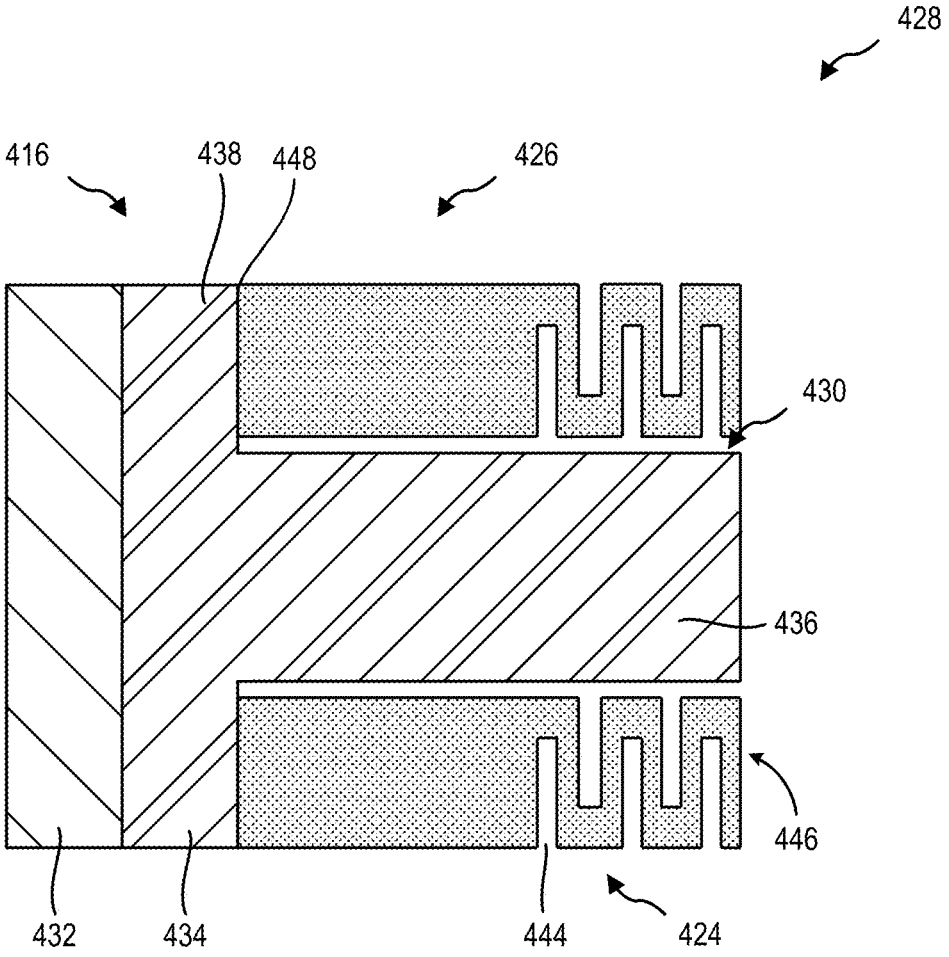
FIG. 4 is a representation of a cutting element assembly having a cutting element secured to a cutter support, according to at least one embodiment of the present disclosure.

FIG. 4 is a representation of a cutting element assembly 428 having a cutting element 416 secured to a cutter support 424 that is connected to a support structure, such as the blade of a bit or other downhole tool, according to at least one embodiment of the present disclosure. The cutter support 424 may include a cutter bore 430 and the cutting element 416 may be inserted into the cutter bore 430. In the embodiment shown, the cutting element 416 includes a cutting table 432 connected to a substrate 434. The substrate 434 includes a tapered portion 436 and a shoulder 438. The tapered portion 436 may be inserted into the cutter bore 430 and the shoulder 438 may be in contact with an upper portion 448 of the cutter support 424.

The cutter support 424 may include a resilient element 426. As discussed herein, the resilient element 426 may be integrally formed with the cutter support 424 (e.g., shoulder 438, substrate 434, and/or tapered portion 436). For example, the resilient element 426 may include one or more grooves 444 in the cutter support 424. The grooves may allow for flexure and/or absorption of forces applied to the cutter support 424 through the cutting element 416. In the embodiment shown in FIG. 4, the resilient element 426 may be located in a base 446 of the cutter support 424. The shoulder 438 of the substrate 434 may engage the upper portion 448 of the cutter support 424, and the resilient element 426 at the base 446 may flex or deflect upon application of a force to the cutting element 416. In some embodiments, the resilient element 426 may be integral with or otherwise coupled to the support structure. Locating the resilient element 426 at the base 446 may help to reduce wear and tear on the resilient element 426 due to cuttings, drilling fluid, or other material infiltrating the one or more grooves 444 during operation.

Figure 5:
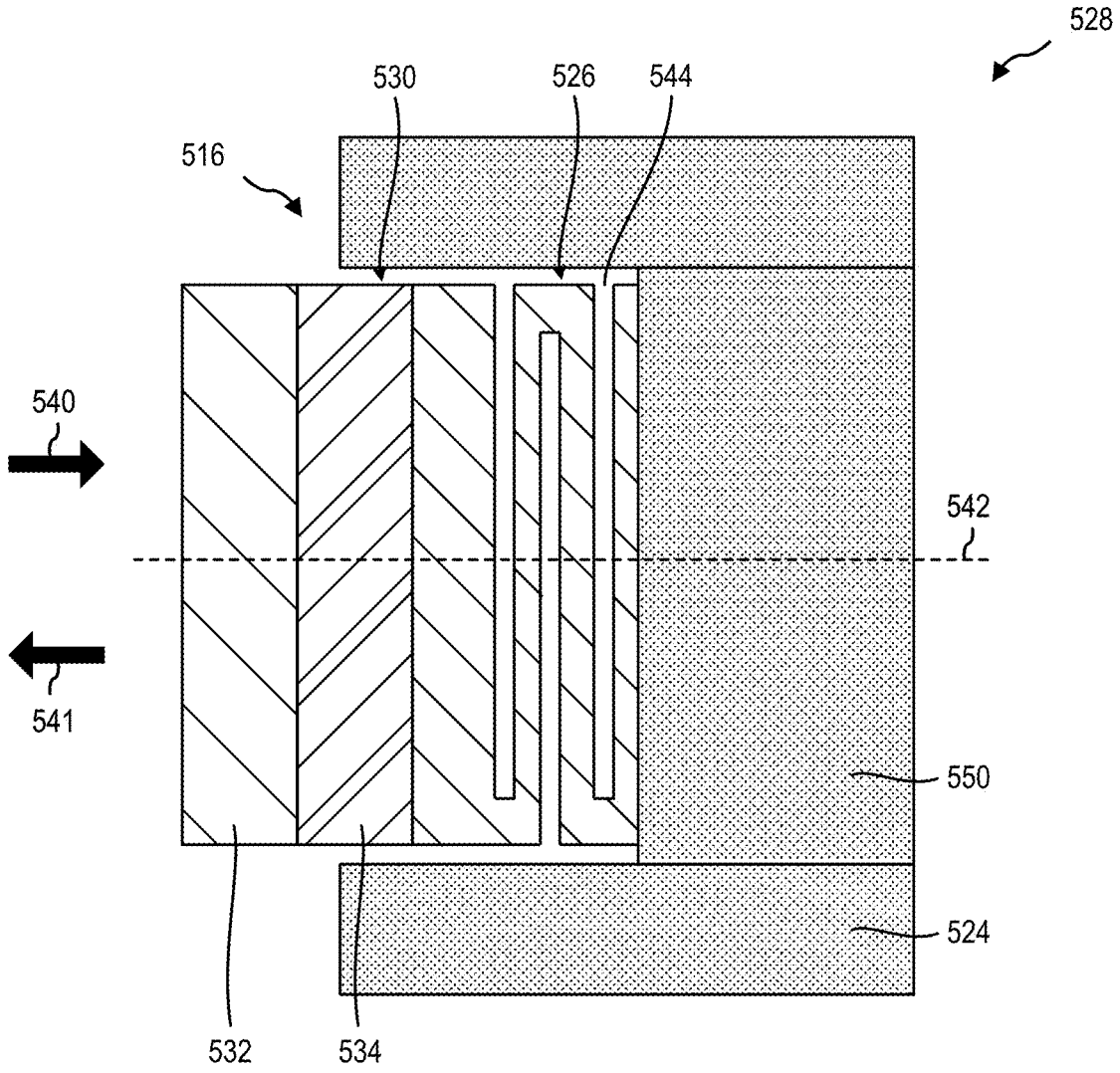
FIG. 5 is a representation of a cutting element assembly having a cutting element secured to a cutter support, according to at least one embodiment of the present disclosure.

FIG. 5 is a representation of a cutting element assembly 528 having a cutting element 516 coupled to a cutter support 524 that is connected to a support structure, such as the blade of a bit or other downhole tool, according to at least one embodiment of the present disclosure. The cutter support 524 may include a cutter bore 530 and the cutting element 516 may be inserted into the cutter bore 530. The cutting element 516 includes a cutting table 532 connected to a substrate 534. The substrate 534 may be inserted into the cutter bore 530 and secured to a base plate 550 of the cutter support 524.

In accordance with at least one embodiment of the present disclosure, the cutting element assembly 528 may include a resilient element 526 that is located in the cutting element 516. In some embodiments, the resilient element 526 is integrally formed with the substrate 534 of the cutting element 516. For example, the substrate 534 may include one or more grooves 544. The substrate 534 may be in contact with the base plate 550.

As the cutting element 516 experiences forces in a generally inward direction 540, the resilient element 526 may compress in the generally inward direction 540 along the longitudinal axis 542. In this manner, the resilient element 526 may absorb at least a portion of the forces applied to the cutting element 516 and cause the cutting element 516 to deflect inward. When the force in the generally inward direction 540 is reduced, the resilient element 526 may apply a force on the cutting element 516 to move the cutting element 516 in the generally outward direction 541.

In some embodiments, the resilient element 526 in the substrate 534 may be formed from the same material as the substrate 534. In some embodiments, the resilient element 526 may be formed from a different material than the rest of the substrate 534. In some embodiments, the substrate 534 may be additively manufactured (e.g., 3D printed), and the substrate 534 may have a material gradient relative to the material of the resilient element 526.

Figure 6:
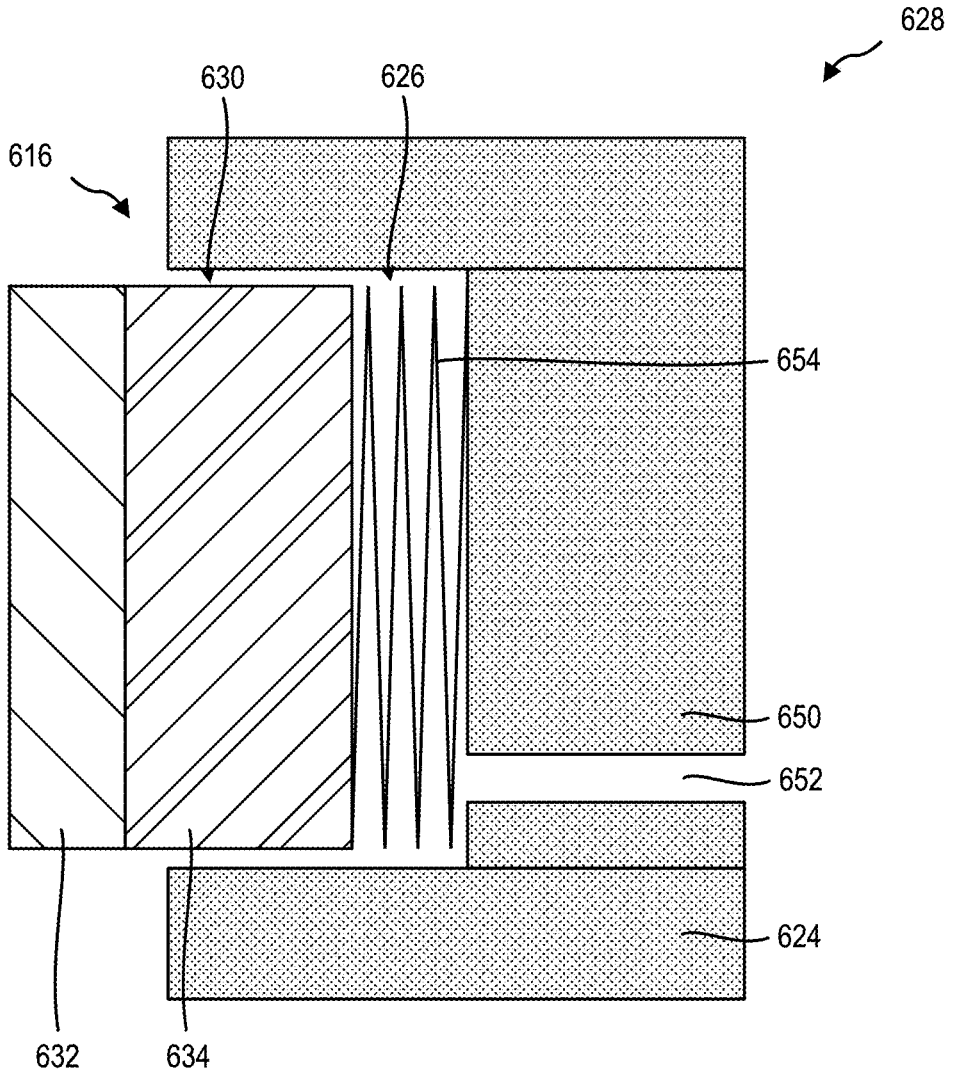
FIG. 6 is a representation of a cutting element assembly having a cutting element secured to a cutter support, according to at least one embodiment of the present disclosure.

FIG. 6 is a representation of a cutting element assembly 628 having a cutting element 616 coupled to a cutter support 624 that is coupled to a support structure such as the blade of a bit or other downhole tool, according to at least one embodiment of the present disclosure. The cutter support 624 may define a cutter bore 630 and the cutting element 616 may be inserted into the cutter bore 630. The cutting element 616 includes a cutting table 632 connected to a substrate 634. The substrate 634 may be inserted into the cutter bore 630 and secured to a base plate 650 or other feature of the cutter support 624.

In some embodiments, the cutting element assembly 628 may include a resilient element 626 between the substrate 634 and a base plate 650. The resilient element 626 may absorb and/or dampen forces applied to the cutting element 616 during operation.

In accordance with at least one embodiment of the present disclosure, the base plate 650 may include a fluid port 652. The fluid port 652 may allow fluid in a chamber 654 between the substrate 634 and the base plate 650 to travel out of and into the chamber 654. When the cutting element 616 is displaced toward the base plate 650, the substrate 634 may push fluid out of the chamber 654 through the fluid port 652. This may allow the cutting element 616 to be more easily displaced within the cutter bore 630. For example, fluid may pass from the chamber 654 through the fluid port 652 easier than through an annulus in the cutter bore 630 between the substrate 634 and the cutter support 624.

When the cutting element 616 moves away from the base plate 650 (such as through a biasing force from the resilient element 626), fluid may enter the chamber 654 through the fluid port 652. In this manner, the cutting element 616 may freely move between the displaced and the non-displaced position with reduced resistance from fluid passing in and out of the chamber 654. This may help to increase the damping effects of the resilient element 626.

Figure 7:
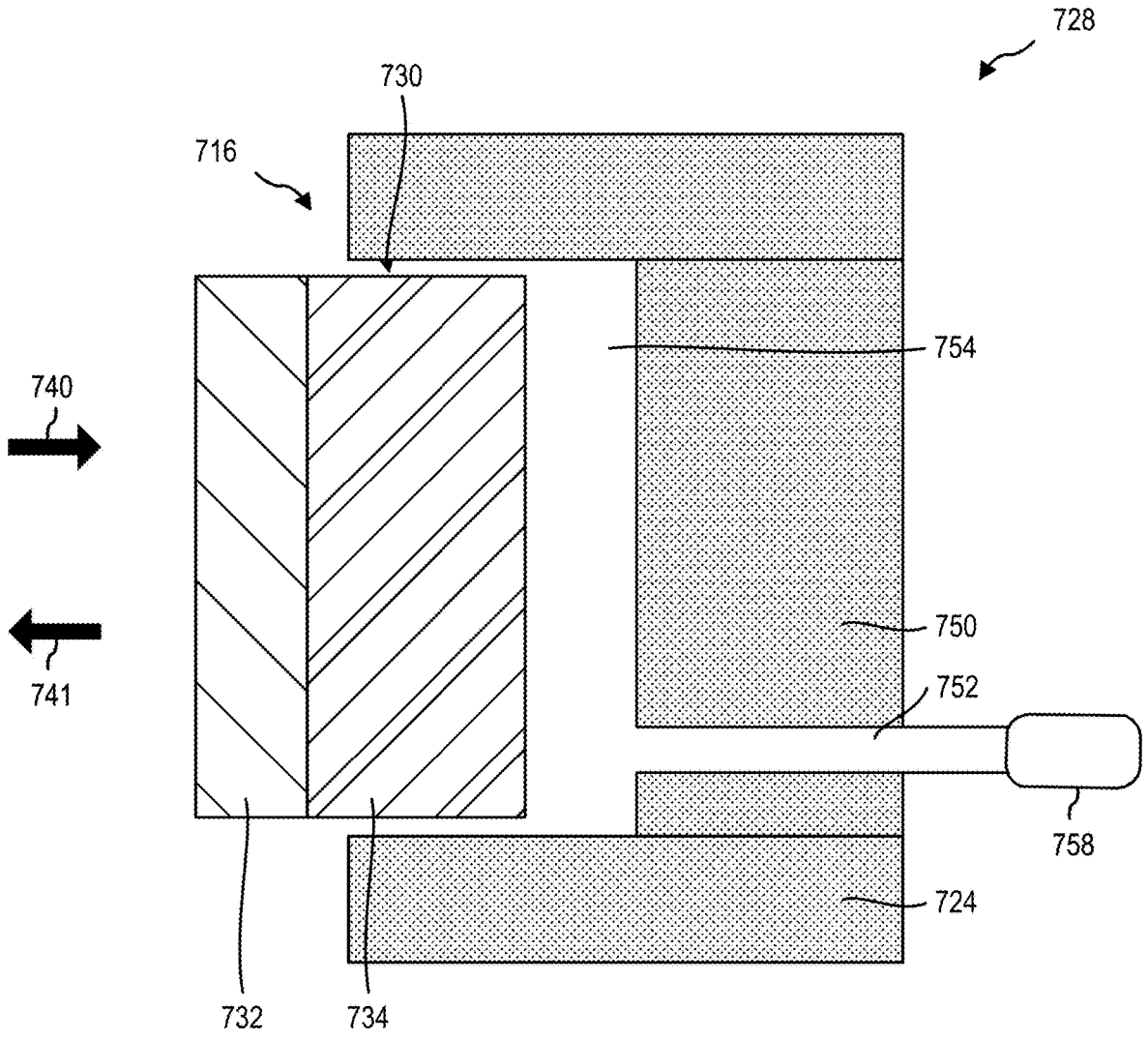
FIG. 7 is a representation of a cutting element assembly having a cutting element secured to a cutter support, according to at least one embodiment of the present disclosure.

FIG. 7 is a representation of a cutting element assembly 728 having a cutting element 716 secured to a cutter support 724 that is connected to a support structure, such as the blade of a bit or other downhole tool, according to at least one embodiment of the present disclosure. The cutter support 724 may include a cutter bore 730 and the cutting element 716 may be inserted into the cutter bore 730. The cutting element 716 includes a cutting table 732 connected to a substrate 734. The substrate 734 may be inserted into the cutter bore 730 and secured to a base plate 750 of the cutter support 724.

In some embodiments, the cutting element assembly 728 may include a damping system between the substrate 734 and a base plate 750. The damping system may absorb and dampen forces applied to the cutting element 716 during operation. The damping system may include a fluid port 752 in the base plate 750. The fluid port 752 may allow fluid in a chamber 754 between the substrate 734 and the base plate 750 to travel out of and into the chamber 754. The fluid port 752 may be connected to a fluid tank 758 with a fluid path.

In some embodiments, the fluid pressure in the chamber 754 may resiliently resist movement of the cutting element 716 based on forces applied to the cutting element 716 during operation. The fluid tank 758 may apply a fluid pressure on the chamber 754. When the cutting element 716 experiences a force in the generally inward direction 740 that exceeds the force applied by the fluid pressure in the chamber 754, a portion of the fluid in the chamber 754 may travel out of the chamber 754, through the fluid port 752 and the fluid path and into the fluid tank 758. When the force decreases, the fluid pressure in the chamber 754 may cause the cutting element 716 to move in the generally outward direction 741. In this manner, the damping system may act as a resilient member and dampen or smooth the forces on the cutting element 716.

In accordance with at least one embodiment of the present disclosure, the damping system may have a variable fluid pressure. For example, the fluid tank 758 may include a hydraulic pump that may adjust the fluid pressure in the chamber 754. In this manner, the damping or the resiliency of the damping system may be variable based on particular drilling conditions. In some embodiments, the pressure of the chamber 754 may be adjusted prior to drilling activities. In some embodiments, the pressure of the chamber 754 may be adjusted while drilling operations are being performed.

Figure 8:
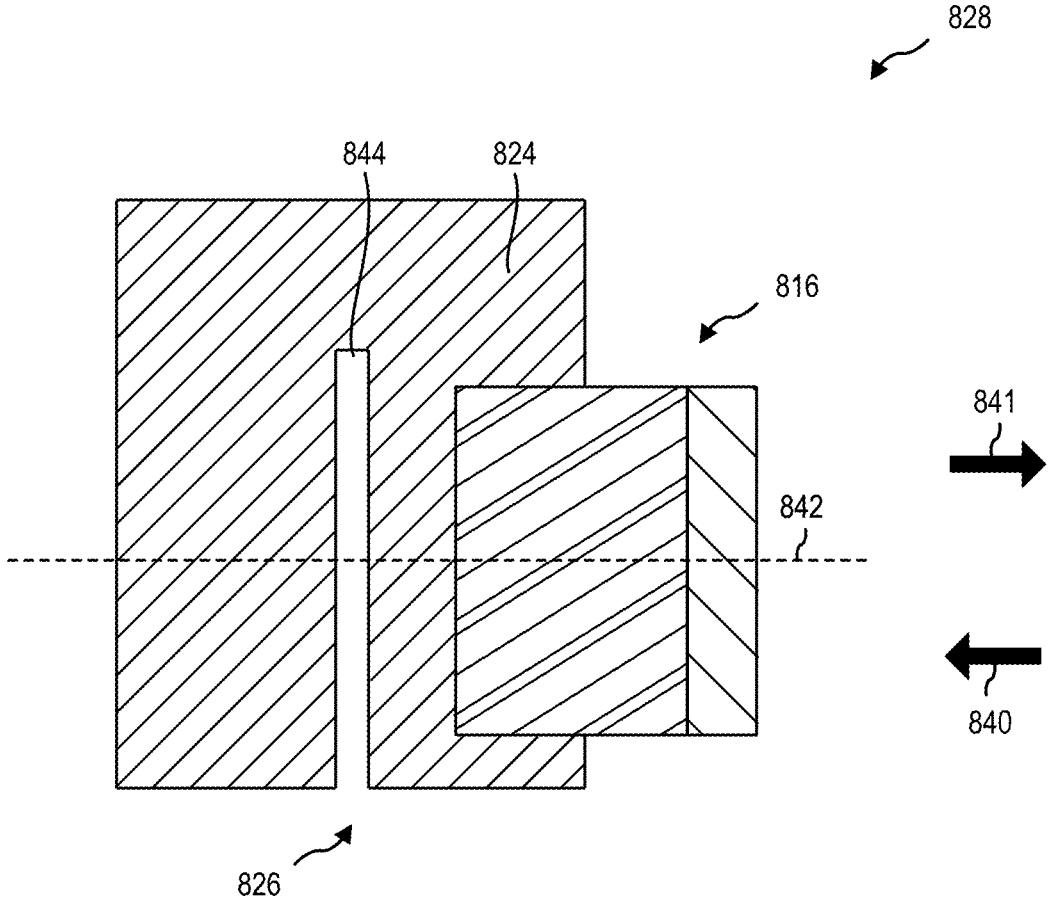
FIG. 8 is a representation of a side-view of a cutting element assembly, according to at least one embodiment of the present disclosure.

FIG. 8 is a representation of a side-view of a cutting element assembly 828, according to at least one embodiment of the present disclosure. The cutting element assembly 828 may include at least one cutting element 816 connected to a cutter support 824. In some embodiments, the cutting element 816 may be rigidly secured to the cutter support 824. For example, the cutting element 816 may be brazed or otherwise rigidly secured to the cutter support 824.

The cutter support 824 may include a resilient element 826 integrally formed into the cutter support 824. In some embodiments, the resilient element 826 may include a groove 844 in the body of the cutter support 824. As discussed herein, the groove 844 may be formed during manufacturing of the cutter support 824. For example, the groove 844 may be cast into the cutter support 824. In some examples, the cutter support 824 may be formed using additive manufacturing, and the groove 844 may be additively manufactured during additive manufacturing of the cutter support 824.

During operation, the cutting element 816 may experience forces (or components of such forces) oriented in the generally inward direction 840. The generally inward direction 840 may be oriented generally parallel to a longitudinal axis 842 of the cutting element 816. When the cutting element 816 experiences the forces in the generally inward direction 840, the resilient element 826 may dampen the forces, absorbing at least a portion of the forces while allowing the cutting element 816 to be displaced along the longitudinal axis 842. After the force on the cutting element 816 is reduced, the resilient element 826 may cause the cutting element 816 to move in a generally outward direction 841. As discussed herein, this may help to maintain contact of the cutting element 816 with the formation.

In some embodiments, the groove 844 may be oriented perpendicular or generally perpendicular to the longitudinal axis 842. This may allow the resilient element 826 to flex into the groove 844 when the cutting element 816 experiences a force in the generally inward direction 840. In some embodiments, the resilient element 826 may include multiple grooves 844 oriented perpendicular or generally perpendicular to the longitudinal axis 842.

Figure 9:
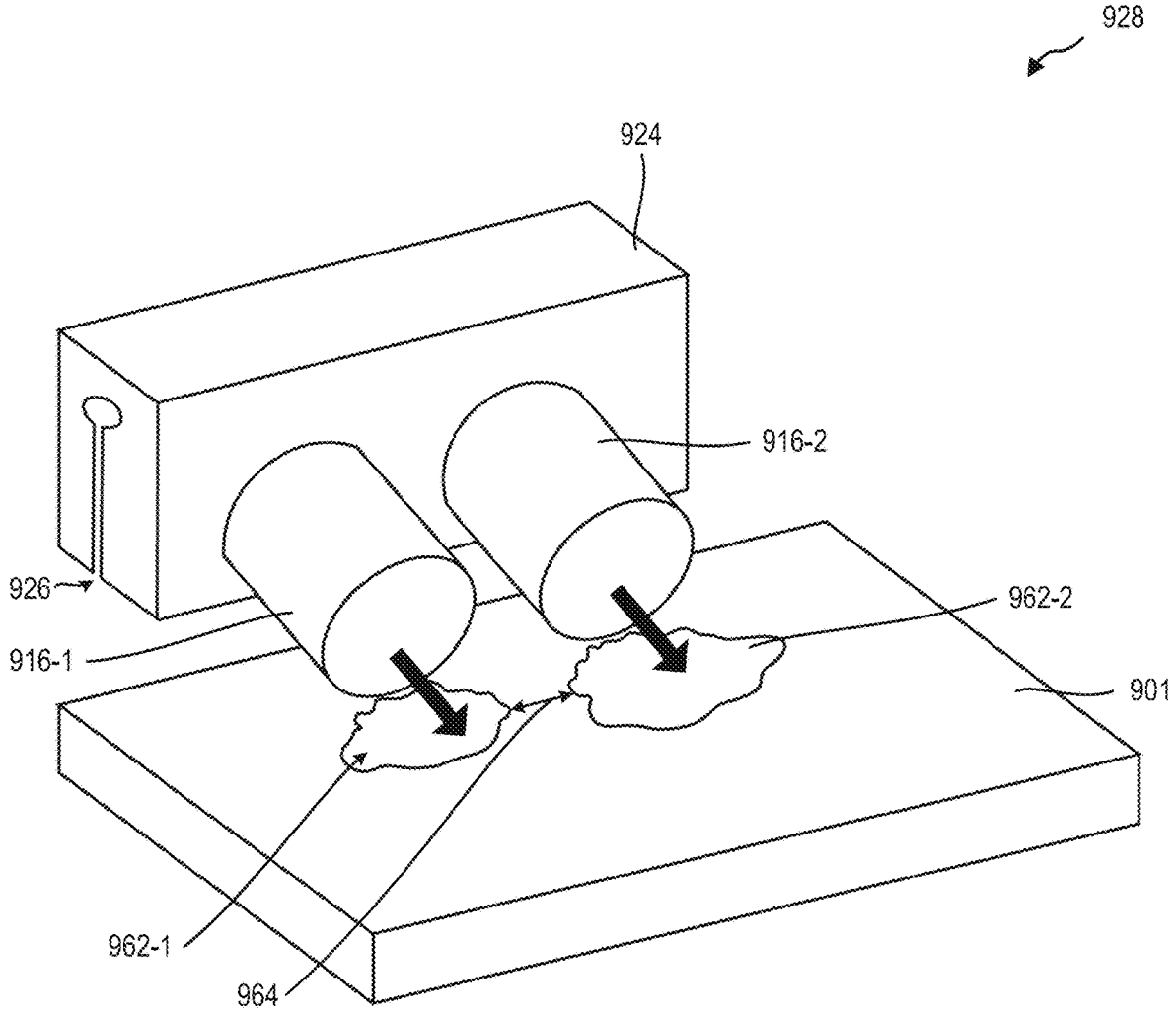
FIG. 9 is a representation of a cutting element assembly having a plurality of cutting elements connected to a single cutter support, according to at least one embodiment of the present disclosure.

FIG. 9 is a perspective view of a cutting element assembly 928 having a plurality of cutting elements 916-1, 916-2 (collectively 916) connected to a single cutter support 924, according to at least one embodiment of the present disclosure. The cutting elements 916 may be rigidly secured to the single cutter support 924, such as by braze or other rigid connection. The embodiment shown includes a first cutting element 916-1 connected to the cutter support 924 and a second cutting element 916-2 connected to the cutter support 924.

The cutter support 924 includes a resilient element 926. The resilient element 926 may absorb forces applied to the cutting elements 916. In some embodiments, each of the cutting elements 916 may be supported by the resilient element 926. The resilient element 926 may absorb at least a portion of the force applied to the cutting elements 916 as the cutting elements 916 engage the formation 901.

During operation and based on variations of the formation 901, adjacent cutting elements 916 may experience different forces based on contact with the formation 901. For example, the first cutting element 916-1 and the second cutting element 916-2 may experience different forces based on differences in the surface of the formation 901 at their location, fractures in the formation 901, and so forth. This may cause chips (collectively 962) in the formation 901 formed by contact of the cutting elements 916 with the formation 901 to be different sizes and/or to be unevenly spaced. For example, a first chip 962-1 may have a different size than a second chip 962-2. Consecutive chips 962 may have a variable spacing 964 between adjacent chips 962. Such variability in chip 962 size and/or spacing 964 may reduce the efficiency of the cutting of the cutting element assembly 928.

In accordance with at least one embodiment of the present disclosure, the resilient element 926 may couple the cutting elements 916 together, or may absorb and distribute forces to both the cutting elements 916. This may even out the forces on the cutting elements 916 as they engage the formation 901. In this manner, the size of the chips 962 and the spacing 964 between consecutive chips 962 may be more regular. This may help to improve the efficiency and engagement of following cutting elements 916 during rotation of the drill bit.

In some embodiments, the first cutting element 916-1 and the second cutting element 916-2 may experience different forces. For example, the first cutting element 916-1 may experience a higher force than the second cutting element 916-2. The resilient element 926 may absorb at least a portion of the first force from the first cutting element 916-1. Because the resilient element 926 is coupled to both the cutting elements 916, when the forces on the cutting elements 916 are reduced, the resilient element 926 may transfer some of this absorbed first force from the first cutting element 916-1 to the second cutting element 916-2. In this manner, the forces between the cutting elements 916 may be coupled and/or smoothed out. This may help to maintain a similar chip size and chip spacing between the cutting elements 916, thereby increasing the drilling efficiency of the cutting element assembly 928. This may increase the rate of penetration of the wellbore and/or reduce drilling costs.

Figure 10:
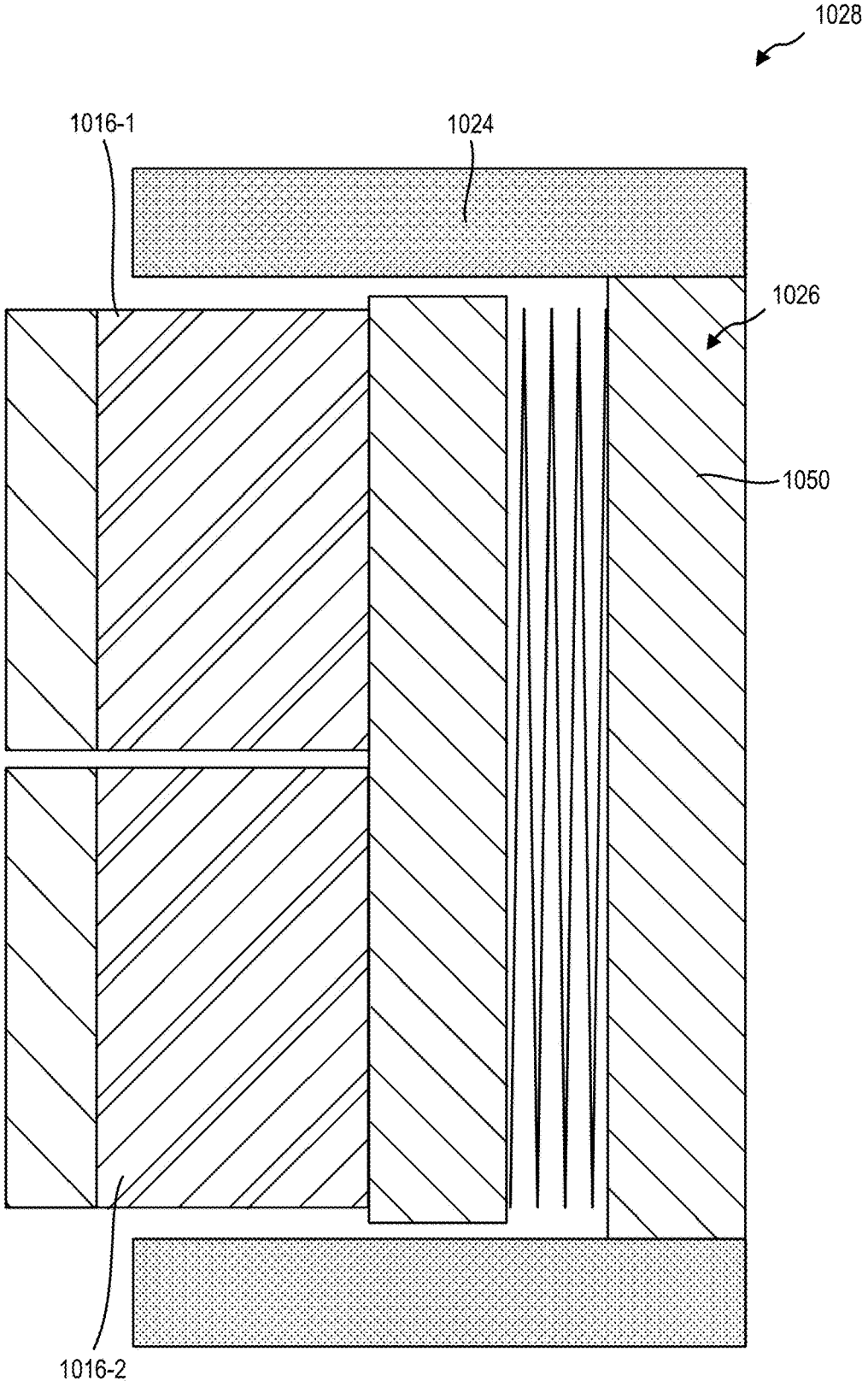
FIG. 10 is a representation of a cutting element assembly having a plurality of cutting elements connected to a single cutter support, according to at least one embodiment of the present disclosure.

FIG. 10 is a cross-sectional view of a cutting element assembly 1028 having a plurality of cutting elements 1016-1, 1016-2 (collectively 1016) connected to a single cutter support 1024, according to at least one embodiment of the present disclosure. The cutting elements 1016 may be secured to the single cutter support 1024. The embodiment shown includes a first cutting element 1016-1 connected to the cutter support 1024 and a second cutting element 1016-2 connected to the cutter support 1024.

The cutter support 1024 includes a resilient element 1026. The resilient element 1026 may absorb forces applied to the cutting elements 1016. In some embodiments, all of the cutting elements 1016 may be supported by the resilient element 1026. In other embodiments, multiple resilient elements may absorb forces applied to the cutting elements 1016 (e.g., one or more resilient elements may be aligned with individual cutting elements 1016 or otherwise included). The resilient element(s) 1026 may absorb at least a portion of the force applied to the cutting elements 1016 as the cutting elements 1016 engage the formation.

In the embodiment shown, the resilient element 1026 is a spring. The resilient element 1026 may be located between the cutter support 1024 and a base plate 1050. When a force is applied to one or both of the first cutting element 1016-1 or the second cutting element 1016-2, the force may be transferred to the resilient element 1026 through the cutter support 1024. Because the cutting elements 1016 are coupled through the resilient element 1026, unbalanced forces applied to the cutting elements 1016 may be at least partially balanced or damped between the cutting elements 1016. This may help to improve contact of the cutting elements 1016 with the formation.

In some embodiments, the cutting element assembly 1028 may include multiple cutting elements 1016 connected to a single cutter support 1024. The cutter support 1024 may be connected to the base plate 1050 using two or more resilient elements 1026. This may help to balance the forces on the cutter support 1024 and prevent binding of the cutter support 1024 on the surrounding housing.

In the embodiment shown, the resilient element 1026 is located between the cutting elements 1016 and the base plate 1050. This may place the resilient element 1026 between the cutting elements 1016 and the support structure. For example, the resilient element 1026 may be located between the cutting elements 1016 and the blade. Locating the resilient element 1026 between the cutting elements 1016 and the support structure may allow the resilient element 1026 to dampen or otherwise absorb at least a portion of the force applied to the cutting elements 1016.

While embodiments of the present disclosure have shown two cutting elements connected to a cutter support (e.g., the first cutting element 916-1 and the second cutting element 916-2 connected to the cutter support 924, the first cutting element 1016-1 and the second cutting element 1016-2 connected to the cutter support 1024), it should be understood that any number of cutting elements may be connected to a cutter support and coupled using one or more resilient elements. For example, 1, 2, 3, 4, 5, 6, 7, 8, 9, 10, or more cutting elements may be connected to the cutter support and coupled using one or more resilient elements. This may help to couple more cutting elements and improve the connection, chip size, and chip spacing of the chips generated by the cutting elements, thereby improving the efficiency of the bit.

In some embodiments, a blade may include a plurality of cutter supports connected to the blade. Each cutter support may include a set of two or more cutting elements. For example, a first cutter support may include a first set of two cutting elements, a second cutter support may include a second set of three cutting elements, and so forth. In some embodiments, each cutting element on a single blade may be connected to a single cutter support. This may help to couple all of the cutting elements on the blade, thereby balancing the forces between each of the cutting elements and improving the drilling efficiency of the bit.

The embodiments of the cutting element assemblies have been primarily described with reference to wellbore drilling operations; the cutting element assemblies described herein may be used in applications other than the drilling of a wellbore. In other embodiments, cutting element assemblies according to the present disclosure may be used outside a wellbore or other downhole environment used for the exploration or production of natural resources. For instance, cutting element assemblies of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A cutting element assembly for use in a drill bit, comprising:

a single, integral cutter support operably connected or connectable to a part of the drill bit; and a plurality of cutting elements separate and distinct from the single, integral cutter support, wherein the plurality of cutting elements are spaced apart from one another and rigidly secured to the single, integral cutter support, and wherein the plurality of cutting elements have exposed surfaces disposed opposite the single, integral cutter support;

wherein the single, integral cutter support has an open groove integrally formed as part of the single, integral cutter support without any physical structure disposed in the open groove, wherein the open groove is configured to extend through the single, integral cutter support offset from the plurality of cutting elements and permit the single, integral cutter support to compress in response to a force applied to the single, integral cutter support through one or more of the plurality of cutting elements and couple together the plurality of cutting elements during a drilling operation.

2. The cutting element assembly of claim 1, wherein the open groove is configured to extend generally perpendicular or transverse to a longitudinal axis of a cutting element of the plurality of cutting elements.

3. The cutting element assembly of claim 1, wherein the plurality of cutting elements includes two cutting elements rigidly secured to the single, integral cutter support.

4. The cutting element assembly of claim 1, wherein the single, integral cutter support is configured to connect to or define a portion of a blade of a downhole cutting tool.

5. A drill bit, comprising:

a bit body;

a plurality of blades;

a single, integral cutter support connected to a given blade of the plurality of blades; and a plurality of cutting elements separate and distinct from the single, integral cutter support, wherein the plurality of cutting elements are spaced apart from one another and rigidly secured to the single, integral cutter support, and wherein the plurality of cutting elements have exposed surfaces disposed opposite the single, integral cutter support, and wherein the single, integral cutter support has an open groove integrally formed as part of the single, integral cutter support without any physical structure disposed in the open groove, wherein the open groove is disposed between the plurality of cutting elements and the given blade of the plurality of blades, and wherein the open groove is configured to extend through the single, integral cutter support offset from the plurality of cutting elements and permit the single, integral cutter support to compress in response to a force applied to the single, integral cutter support through one or more of the plurality of cutting elements and couple together the plurality of cutting elements during a drilling operation.

6. The drill bit of claim 5, wherein the open groove comprises at least one of a void or a slit.

* * * * *